US006386478B2

(12) United States Patent
Reilly

(10) Patent No.: US 6,386,478 B2
(45) Date of Patent: May 14, 2002

(54) QUICK AND SANITARY PAPER ROLL DISPENSER

(76) Inventor: Robert E. Reilly, 73-440 Little Bend Trail, Palm Desert, CA (US) 92260

( * ) Notice: Subject to any disclaimer, the term of this patent is extended or adjusted under 35 U.S.C. 154(b) by 0 days.

(21) Appl. No.: 09/789,326

(22) Filed: Feb. 20, 2001

Related U.S. Application Data

(63) Continuation-in-part of application No. 09/436,177, filed on Nov. 8, 1999, now Pat. No. 6,189,828.
(60) Provisional application No. 60/183,906, filed on Feb. 22, 2000.

(51) Int. Cl.[7] ..... B65H 18/04
(52) U.S. Cl. ..... 242/596.4; 242/596.7
(58) Field of Search ..... 242/596.3, 596, 242/596.4, 596.5, 596.8, 596.6, 598.2, 598.1, 596.7, 599.2, 599.3, 599.4

(56) References Cited

U.S. PATENT DOCUMENTS

| | | | |
|---|---|---|---|
| 1,913,363 | A | 6/1933 | Allen |
| 1,987,154 | A | 1/1935 | Noffsinger |
| 2,643,069 | A | 6/1953 | Carlin |
| 3,823,889 | A | 7/1974 | Johnson et al. |
| 4,452,403 | A | 6/1984 | Arronte |
| 4,553,710 | A | 11/1985 | Pool |
| 4,662,576 | A | 5/1987 | Paul |
| 5,253,818 | A | 10/1993 | Craddock |
| 5,653,403 | A | 8/1997 | Ritchey |
| 5,720,447 | A | 2/1998 | Brechko |
| 5,813,624 | A | 9/1998 | Grasso |
| 5,868,347 | A | 2/1999 | Paul et al. |

*Primary Examiner*—William A. Rivera
(74) *Attorney, Agent, or Firm*—Knobbe, Martens, Olson & Bear, LLP

(57) ABSTRACT

An apparatus for holding a roll of paper having a mounting section with two arms extending outward therefrom. Each arm is hollow and includes an aperture on the inner surface of the arms. Pivoting members are mounted within the arms and are spring biased into a first position where the pivoting members support the roll of paper. The pivoting members includes cavity shields that prevent the entry of debris into the arms and the springs are secured to the pivoting members and the arms so as to inhibit the springs from being dislodged. The pivoting members are further biased such that the pivoting members can be retracted into a second position as a result of a user moving the roll of paper against the pivoting members in a first direction.

25 Claims, 5 Drawing Sheets

QUICK AND SANITARY PAPER ROLL DISPENSER

RELATED APPLICATIONS

This application is a continuation in part of U.S. patent application Ser. No. 09/436,177 which was filed on Nov. 8, 1999 and issued as U.S. Pat. No. 6,189,828 on Feb. 20, 2001. This application also claims the benefit of U.S. Provisional Patent No. 60/183,906 which was filed on Feb. 22, 2000. This application hereby incorporates by reference the above two applications.

BACKGROUND OF THE INVENTION

1. Field of the Invention

The present invention relates generally to paper roll dispensers and, more specifically, concerns a more robust sanitary paper dispenser that inhibits the introduction of particle matter into the internal portion of the dispenser and provides a uniform and flat surface for easy cleaning.

2. Description of the Related Art

It has long been appreciated physically challenged persons have a difficult time installing paper rolls into conventional paper roll dispensers. Conventional dispensers often comprise a cylindrical shaft that fits into the hollow inner diameter of the paper roll, and the shaft often includes a smaller diameter knob at both ends. Usually, one knob is spring biased outward along the axis of the shaft and, when biased into a cavity in the wall, retains the cylinder along with the paper roll. This installation process requires the use of two hands and fine motor skills. In particular, one must hold onto the paper roll with one hand, insert the cylinder with the other hand, then gather the two components in one hand, bias the knob into the cylinder with the other hand, and then insert the knobs into the two receiving recesses in the wall. However, for many people, like the thousands of people suffering from arthritis, this procedure is too painful or difficult to perform. Hence, there is a need for a toilet paper roll dispenser allowing for quick and easy installation and removal of the paper roll.

It has also long been appreciated that germs can cause illness in humans. Germs are especially prevalent in restrooms on toilet paper dispensers, mainly because bodily waste products are within close proximity and because persons touching the dispensers often do so with unwashed hands. These germs can be passed on to the next person touching the dispenser and cause illness in the recipient. Also, dispenser designs often include recesses and other inaccessible features making cleaning very difficult. Hence, there is an on-going problem of paper dispensers that retain germs and are difficult to clean.

Various dispensers have been developed which retain the roll of paper with a pair of pivoting support members. These dispensers allow the user to install and remove the paper roll with one hand in one easy upward motion. For example, U.S. Pat. No. 4,553,710 discloses several types of paper roll dispensers which retain the roll of paper with a pair of pivoting support members. In particular, U.S. Pat. No. 4,553,710 discloses paper roll dispensers utilizing a pair of support members biased to pivot and enter the hollow section of the paper roll. Furthermore, the support members shown in U.S. Pat. No. 4,553,710 can retract into the main structure of the dispenser when either removing or inserting a roll of paper. In fact, products have become marketed, like those distributed by Rubbermaid, that include retractable support members similar to the members disclosed in U.S. Pat. No. 4,553,710.

While the dispensers disclosed in U.S. Pat. No. 4,553,710 and the Rubbermaid product have been particularly effective in reducing the time and effort needed to remove or insert a roll of paper, these dispensers are susceptible to the retention of germs and foreign particles. More specifically, when the support members are pivoted outward, the design leaves open apertures when the paper roll is installed. These apertures provide a path to the internal portion of the dispenser, and these are prime locations for germs and foreign particles to accumulate and potentially cause illness to all coming in contact with the dispenser. Also, the affected areas are difficult to clean because they are inaccessible inner surfaces.

The dispensers disclosed in U.S. Pat. No. 4,553,710 and the Rubbermaid product can also be difficult to assemble. For instance, the Rubbermaid product comprises two springs, two pivoting members, and two halves of a dispenser shell housing. Neither the springs nor the pivoting members can be rigidly attached to the shell housing during assembly. Instead, during assembly, the pivoting members swing freely on flanges extending from one half of the shell housing, and one end of the springs resides inside the hollow of the pivoting member. Then, the other half of the shell housing must be lowered onto the first half of the shell housing as the springs are bent and lined up with retainer posts on the lowered half. Hence, assembly of this Rubbermaid product can be time consuming and expensive.

Last, the Rubbermaid product is not a robust design because the pivoting members are prone to failure. More specifically, the springs bend from inside the pivoting members, around the base of the pivoting members, to the base of the dispenser shell housing. The bending of the spring results in a lateral offset of the spring, and this lateral offset actually biases the spring to eject out of the pivoting members where they can no longer bias the pivot members. If the springs bias out of the pivoting member, then the pivoting member will not bias and will not be able to support a paper roll. To account for this weakness, Rubbermaid designers have utilized overly long and overly stiff springs. Unfortunately, even these springs are still prone to bias out of the pivot members, and the overly stiff springs may actually impair the user's ability to install a roll of paper. Hence, the robustness of the Rubbermaid product could be significantly improved.

From the foregoing, it will be appreciated that there is a need for an improved paper roll dispenser that keeps germs from entering the dispenser assembly and is easy to clean. It will also be appreciated that there is a need for an improved paper roll dispenser that is easy and inexpensive to assemble. Last, it will be appreciated that there is a need for a more robust paper roll dispenser.

SUMMARY OF THE INVENTION

The aforementioned needs are satisfied by the paper roll dispenser of the present invention which, in one aspect, comprises a base member adapted to mount the apparatus onto a wall and a first and second arm having an inner and outer face wherein the first and second arms extend outward from the mounting plate so as to be spaced a first distance apart, the first distance being selected to be larger than the width of the roll of paper. The arms also have apertures formed on the outer surfaces of the first and second arm members.

This aspect of the present invention also includes a first and a second pivoting member each defining an outer perimeter and an apex where the first and second pivoting members are respectively mounted in the apertures in the first and second arms. The first and second pivoting members are biased inward into the space between the first and second arms in a first orientation such that the apex of the first and second pivoting arms are positioned a second distance apart that is less than the length of the roll of paper such that the roll of paper can be retained on the first and second pivoting members. The first and second pivoting members can be moved into a second orientation such that the apex of the first and second pivoting members are spaced a third distance apart that is greater than the length of the roll to permit removal of the roll.

This aspect of the present invention also includes a first and second cavity shield respectively mounted about the outer perimeter of the first and second pivoting members so as to extend outward therefrom a distance that is selected such that the first and second cavity shield contact the inner surface of the first and second arms when the first and second pivoting members are in the first orientation such that the first and second cavity shields substantially seal the first and second apertures.

In one embodiment, the first and second pivoting members are biased and have an angled surface that is angled such that positioning a roll of paper against the angled surface and exerting pressure against the roll of paper such that it exerts pressure against the first and second pivoting member results in the pivoting members moving from the first orientation to the second orientation to permit installation of the roll of paper. Similarly, to remove the roll of paper, the first and second pivoting members are biased such that moving the roll of paper away from the angled surface results in the first and second pivoting members moving into the second orientation.

In this way, installation and removal of the roll of paper is greatly simplified as the person simply has to grasp the roll of paper and push it against the pivoting members. For individuals with infirmities, this apparatus reduces the need for using both hands and compressing springs and the like to install the paper. Further, since the cavity shields extend outward from the outer perimeter of the first and second pivoting member, the entry of debris and particulate matter into the interior of the apparatus can be reduced thereby resulting in a more sanitary apparatus.

In another aspect, the present invention comprises a base member adapted to mount the apparatus onto a wall and a first and second arm having an inner and outer face wherein the first and second arms extend outward from the mounting plate so as to be spaced a first distance apart, the first distance being selected to be larger than the width of the roll of paper. The arms also have apertures formed on the outer surfaces of the first and second arm members.

This aspect of the present invention also includes a first and a second pivoting member each defining an outer perimeter and an apex where the first and second pivoting members are respectively mounted in the apertures in the first and second arms. The first and second pivoting members are biased inward into the space between the first and second arms in a first orientation such that the apex of the first and second pivoting arms are positioned a second distance apart that is less than the length of the roll of paper such that the roll of paper can be retained on the first and second pivoting members. The first and second pivoting members can be moved into a second orientation such that the apex of the first and second pivoting members are spaced a third distance apart that is greater than the length of the roll to permit removal of the roll. In this aspect, the first and second pivoting members are biased by springs that extend from an interior surface of the first and second arms respectively into the first and second pivoting members. Moreover, the springs are retained in contact with the interior surface and the interior of the pivoting member by retainers such that repeated operation of the pivoting members is less likely to result in the spring being dislodged.

In one specific embodiment, the first and second arms are hollow and the springs are mounted so as to extend laterally across the arms so as to be adjacent the pivoting members. In another embodiment, the springs extend from a bottom surface of the arms to a position adjacent the pivoting members. The use of the retainers in both embodiments results in a more easily assembled, more robust design.

Hence, the paper roll holder of the present invention is more sanitary, more robust and easier to assemble than similar dispensers of the prior art. These and other objects and advantages will be more apparent from the following description taken in conjunction with the accompanying drawings.

DETAILED DESCRIPTION OF THE PREFERRED EMBODIMENT

Figure 1A:
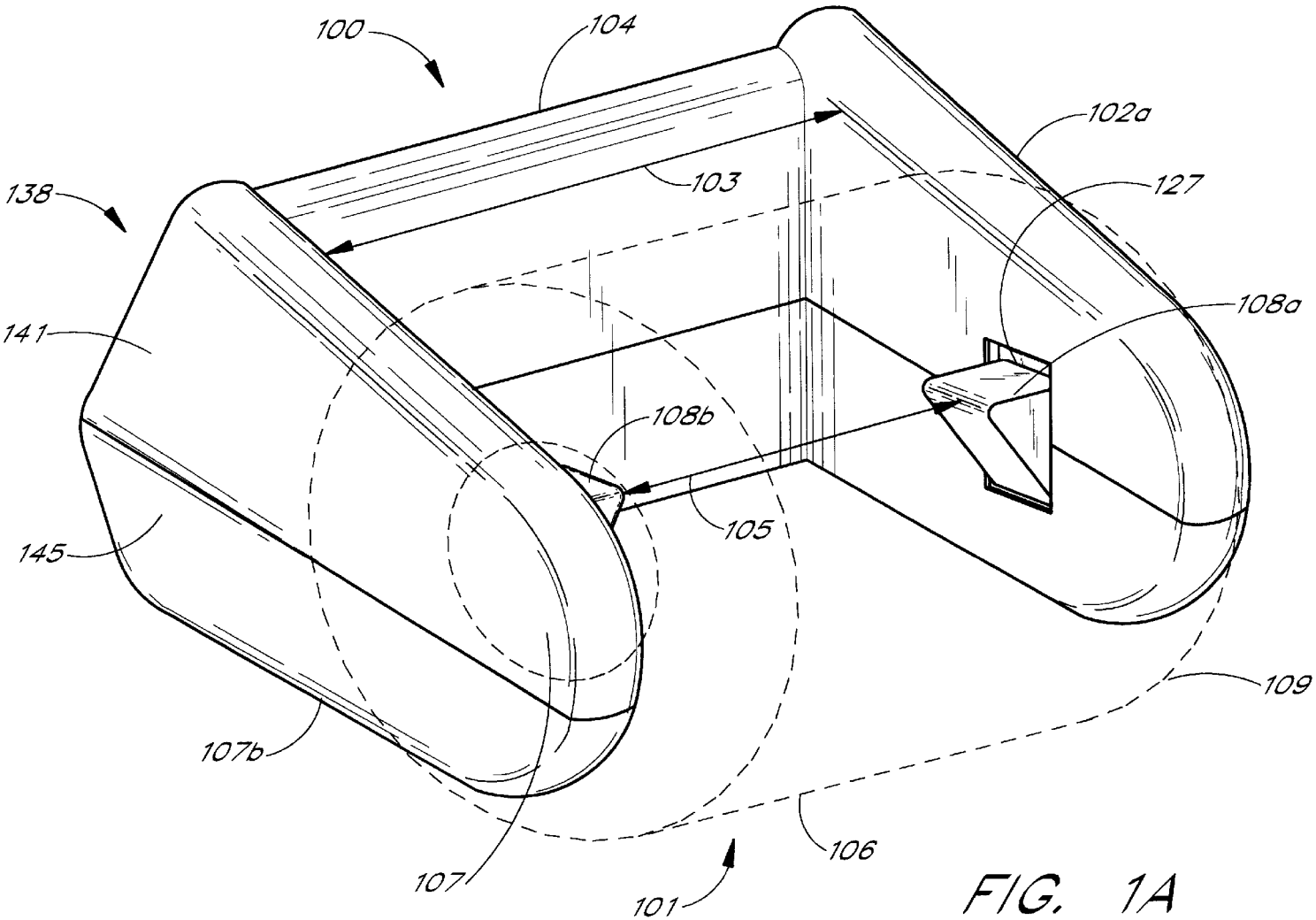
FIGS. 1A and 1B are isometric views illustrating a paper roll dispenser assembly incorporating two pivoting retainer members with cavity shields.
Figure 1B:
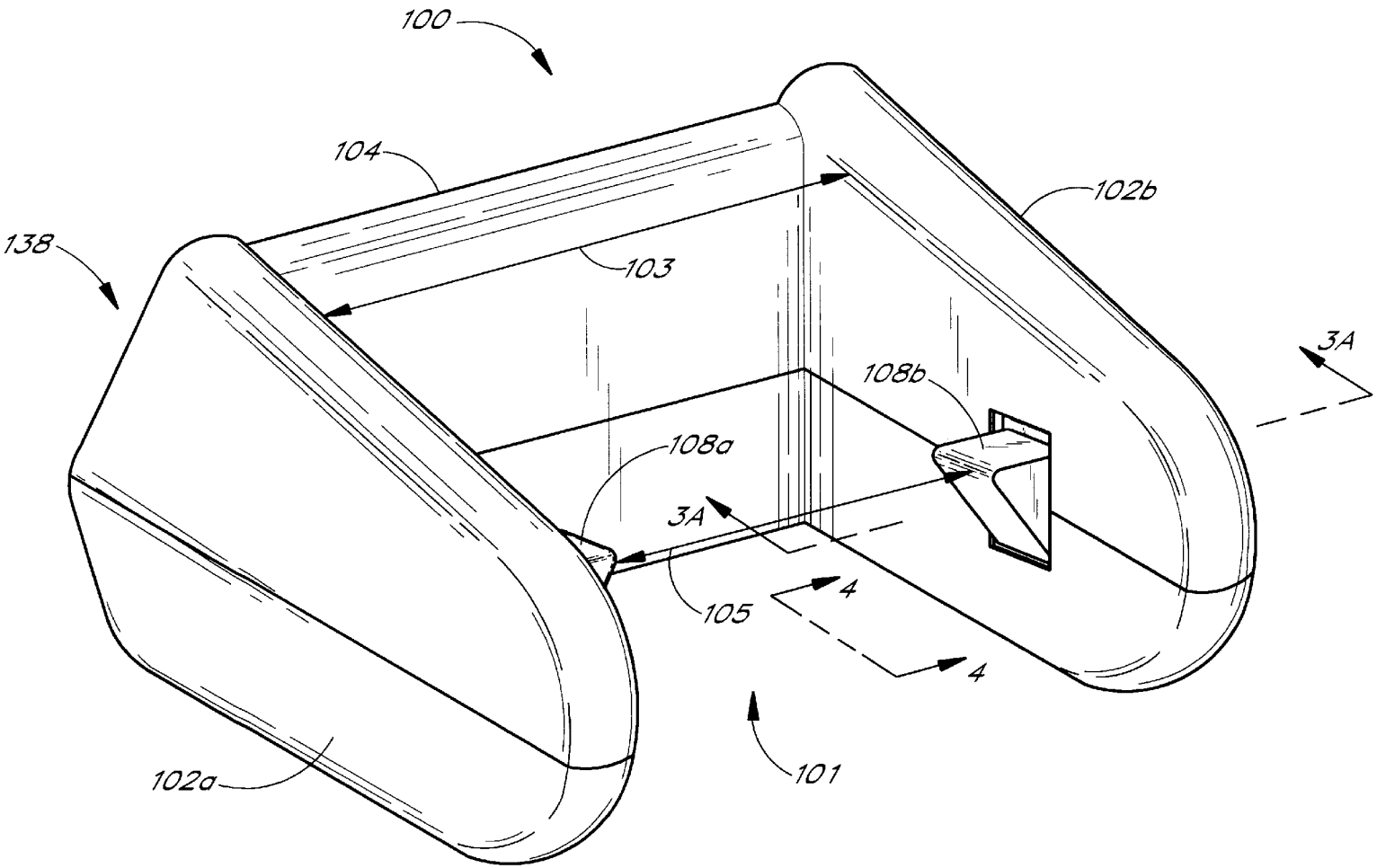

Reference will now be made to the drawings wherein like numerals refer to like parts throughout. Referring to FIGS. 1A and 1B, one embodiment of a paper roll dispenser assembly 100 is illustrated. As shown, the paper roll dispenser assembly 100 is generally a U-shaped shell 138 comprising a base member 104, the portion that will attach onto a wall, and a first and second side arm 102*a*, 102*b*. The first and second side arms 102*a*, 102*b* extend perpendicularly from the base member 104. Also, the first and second side arms 102*a*, 102*b* are separated by a first distance 103. Preferably, the arms define a space 101 having a width of the first distance 103. The first distance 103 is wider than the paper roll 106 so that the paper roll 106 can fit in the space 101 between the first and second side arms 102*a*, 102*b* and be retained in a manner to be discussed in further detail below.

In the preferred embodiment, the shell 138 comprises an upper half shell 141 and a lower half shell 145. When the upper half shell 141 and the lower half shell 145 are joined, the shell 138 is hollow, making room for a first and second pivot member 108*a*, 108*b* to protrude perpendicularly from an aperture 127 in the first and second side arms 102*a*, 102*b* and point toward the center of the space 101. The pivot members 108*a*, 108*b* are assembled into the side arms 102*a*, 102*b* in a manner to be described below. The first and second pivot members 108*a*, 108*b* are spaced apart a second distance 105. Preferably, the second distance 105 is less than the length of the paper roll 106 so that the paper roll can be held up by the pivoting members 108*a*, 108*b*. More specifically, the pivoting members 108*a*, 108*b* will fit inside a cylindrical hollow core 107 around which the paper 109 of the paper roll 106 is wound. In this way, the first and second pivot members 108*a*, 108*b* support the paper roll 106.

In one embodiment, the shell 138 and the pivot members 108*a*, 108*b* are made from a lightweight plastic known in the art. It will be appreciated that the overall form of the base member 104, the first and second arms 102*a*, 102*b*, and the pivot members 108*a*, 108*b* can take on a variety of shapes without departing from the spirit of the present invention.

Figure 2:
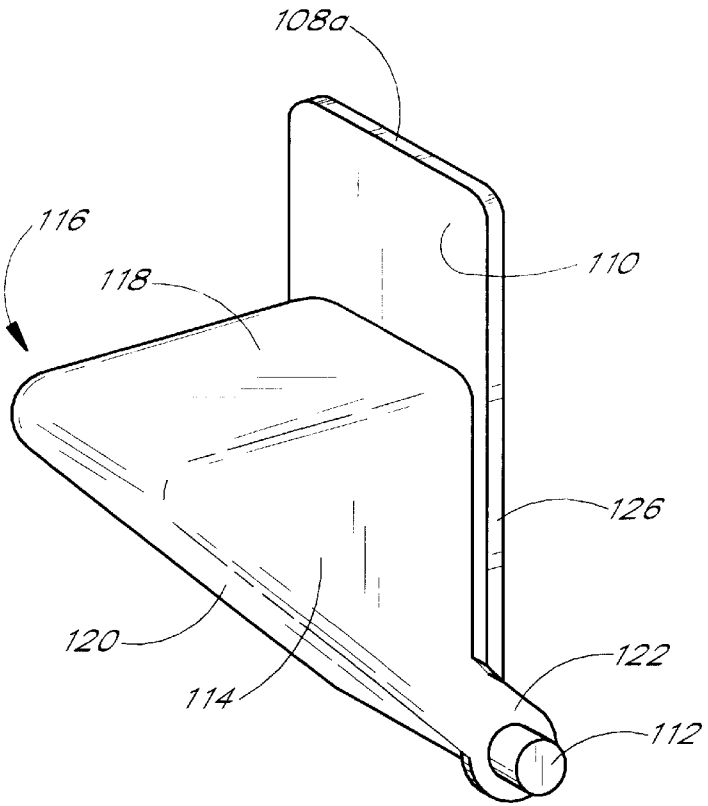
FIG. 2 is an isometric view of a pivoting member included in the paper roll dispenser shown in FIGS. 1A and 1B.

FIG. 2 illustrates an isometric view of the first pivot member 108*a*. It will be appreciated that the second pivot member 108*b* shares the same features with the first pivot member 108*a*. In the embodiment shown, the pivot member 108*a* comprises various thin-walled surfaces. More specifically, the pivot member 108*a* comprises a top face 118 which provides a surface for a paper roll 106 to sit in a manner to be discussed in further detail below. A front face 120 extends at an acute angle from the top face 118 so as to provide a surface for the paper roll 106 to push on and bias the pivot member 108*a* to thereby induce the pivot member 108*a* to pivot in a manner to be discussed in further detail below. Also, a first side 114 perpendicularly connects both the top face 118 and the front face 120. Similarly, a second side 116 perpendicularly connects the other side of the top face 118 and the front face 120.

The pivot member 108*a* also includes a cavity shield 110 that extends ninety degrees from the top face 118 and from the first and second sides 114, 116. This cavity shield 110 performs two functions, both of which will be discussed in further detail below. First, the cavity shield 110 prevents germs and foreign particles from entering the paper roll dispenser 100 through the aperture 127. Second, the cavity shield limits the rotation of the pivoting member 108*a*.

Also, connected to both the first and second sides 114, 116 is a half-circle protrusion 122. Centered on the protrusion 122 is a cylinder 112. As is illustrated in FIG. 2, the protrusion 122 is located at the bottom of the pivot member 108*a* adjacent the rear surface. In the preferred embodiment, the cylinder 112 is short—approximately twice the thickness of the protrusion 122. The cylinder 112 provides a means of supporting the pivoting member 108*a* when installed into the paper roll dispenser 100 as will be described in greater detail below.

Figure 3B:
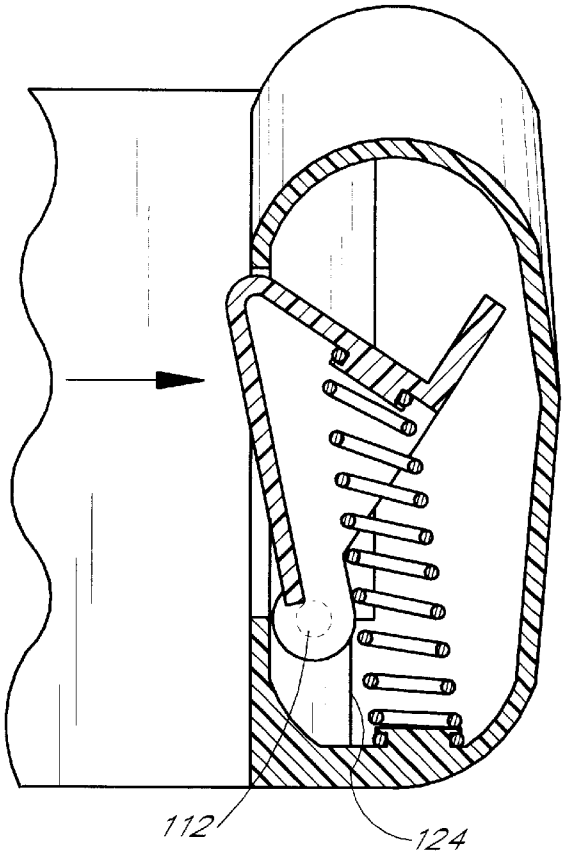
FIGS. 3A and 3B are cross-sectional views of the paper roll dispenser assembly of FIG. 1B taken along the lines of 3A—3A and 3B—3B.
Figure 3A:
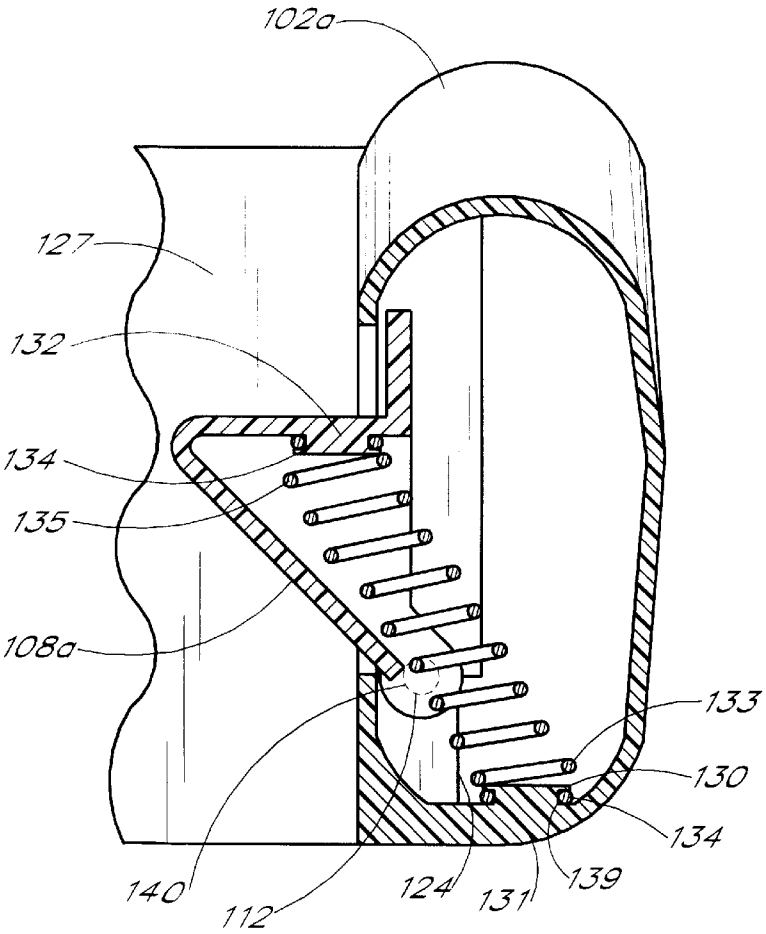

More specifically, FIGS. 3A and 3B illustrate the assembly of the first pivot member 108*a* into the first side arm 102*a*, and also reveal inner features of the pivot member 108*a* and the side arm 102*a*. It will be appreciated that the second pivot member 108*b* is assembled into the second side arm 102*b* in the same manner.

As shown in FIGS. 3A and 3B, a first support mount 130 is located inside a cavity 121 of the pivoting member 108*a* on the bottom interior wall of the first side arm 102*a*. The first support mount 130 is a cylindrical outgrowth that defines a lip 131 and a recessed surface 139. In the preferred embodiment, the end of the first support mount includes a collar 134. The collar 134 is an extremely short cylinder of a slightly larger diameter than the first support mount 130. The combination of the first support mount 130 and the collar 134 provide a mechanism of retaining a spring 128 in a manner to be discussed in greater detail below.

Also located on the bottom interior wall of the first side arm 102*a* is a support 124. The support 124 is a thin, rectangular outgrowth that extends from the bottom surface 191 of the cavity 143 of the side arm 102 almost to the base of the aperture 127. The support 124 supports the pivoting member 108*a*. Specifically, the support 124 includes a pair of grooves 140 which are cut to a diameter greater than the diameter of the cylinders 112. The grooves 140 provide a location to seat the cylinders 112 of the pivoting member 108*a* into the support 124; thus, the grooves 140 prevent the pivoting member 108*a* from dislocating from the support 124.

FIGS. 3A and 3B illustrate a second support mount 132 located on the interior wall of the top face 118 of the pivot member 108*a*. The second support mount 132 is a cylindrical outgrowth of the same diameter as the first support mount 130. Likewise, the second support mount includes a collar 134 as described above. The combination of the second support mount 132 and the collar 134 provide a means of retaining the spring 128 in a manner to be discussed in greater detail below.

As shown in FIGS. 3A and 3B, the cylinders 112 of the pivot member 108*a* fit into the grooves 140 atop the supports 124 in a manner that supports the pivot member 108*a*. The grooves 140 also permit the pivot member 108*a* to pivot around the axis of the cylinder 112. As shown, the spring 128 further connects the pivot member 108*a* to the rest of the side arm 102*a*. A first end 133 of the spring 128 attaches to the side arm 102*a* by way of the first support mount 130. Preferably, the diameter of the first support mount 130 is larger than the inner diameter of the spring 128 so as to create an interference fit between the spring 128 and the support 130. Similarly, a second end 135 of the spring 128 attaches to the second support mount 132 in the same manner.

It should be noted that the collars 134 on the support mounts 130, 132 further retain the spring 128. This is because the diameter of the collar 134 is such that it creates a ridge that rides over and holds the ends 133, 135 of the spring 128 in the recesses 139 to either the pivot member 108*a* or the first side arm 102*a*. Hence, the spring 128 is retained because of the interference force between the spring 128 and the first support mount 130, and the spring 128 is further retained due to the hold down force that the collar 134 exerts on the spring 128.

Advantageously, the force of the collar 134 on the spring 128 provides a rigid attachment for the spring 128 and prevents the spring 128 from shifting excessively when the pivot member 108*a* is biased. Thus, the paper roll dispenser 100 is robust because the spring 128 is more likely to stay in position and remain functional for the life of the paper roll dispenser 100. The collar 134 also allows for easy assembly of the paper roll dispenser 100 because, during assembly, the ends 133, 135 of the spring 128 can be rigidly attached to the spring mounts 130, 132, leaving the person assembling the paper roll free to manipulate other features of the paper roll dispenser 100.

As shown in FIG. 3B, when force is applied to the front face 120 of the pivot member 108*a*, the pivot member 108*a* pivots toward the inside of the side arm 102*a* thereby compressing the spring 128. Then, once the force is removed, the spring 128 force biases the pivot member 108*a* outward from the side arm 102*a*. The pivot member 108*a* rotates outward until the cavity shield 110 makes contact with the wall of the aperture 127. Preferably, the position of the cavity shield 110 stops the pivot member 108*a* when the top face 118 of the pivot member 108*a* is perpendicular to the plane of the aperture 127.

Figure 4:
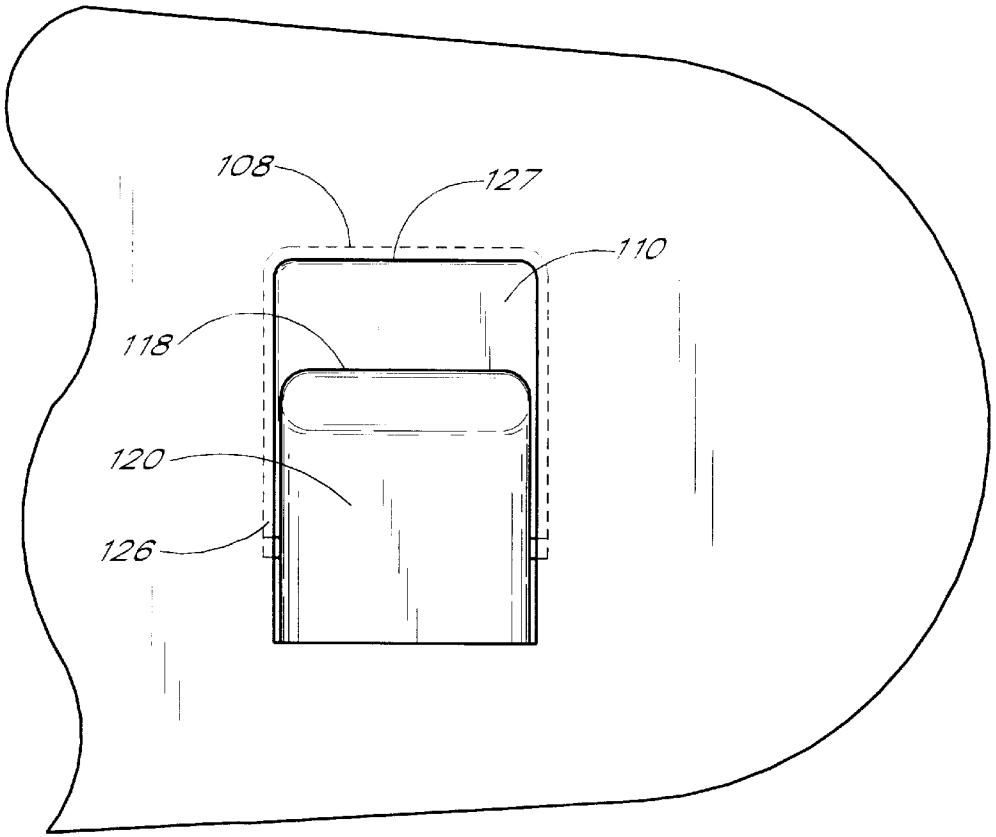
FIG. 4 is a front view of the paper roll dispenser assembly of FIG. 1B taken along the lines of 4—4.

FIG. 4 illustrates the pivot member 108*a* assembled into the first side arm 102*a* from a vantage point looking directly into the aperture 127. The pivot member 108*a* is shown rotated to a position where it is at rest. As shown, the pivot member 108*a* has come to rest because the cavity shield 110 has made contact with the walls of the aperture 127. Also illustrated in FIG. 4 is the cavity shield 110 covering the open portion of the aperture 127 lying above the top face 118 of the pivot member 108*a*. The cavity shield inhibits foreign particles from entering the side arm 102*a* through the aperture 127. As is also illustrated in FIGS. 2 and 4, the cavity shield preferably includes portions 126 that extend outward along the side walls 114, 116 of each of the pivoting members 108*a*, 108*b* so as to inhibit the entry of foreign particles in the gap between the wall of the apertures 127 and the walls 114, 116 of the pivoting members 108*a*, 108*b*. Advantageously, by sealing off the aperture 127, the cavity shields prevent the growth and spread of germs inside the hollow side arm 102*a*. Thus, the cavity shields reduce the accumulation of waste and germs.

Ordinarily, the pivot members 108*a*, 108*b* will be pivoted when the paper roll 106 is inserted and removed. To insert the paper roll 106, the user can turn the paper roll 106 horizontally and raise the paper roll 106 into the first distance 103 between the two side arms 102*a*, 102*b*. Then, as the paper roll 106 is raised, the paper roll 106 will make contact with the angled front face 120 of the pivot members 108*a*, 108*b*. This urges the pivot members 108*a*, 108*b* to retract into the first and second side arms 102*a*, 102*b* and thereby compress the springs 128. Once the paper roll 106 is centered in the paper roll assembly 100, the pivot members 108*a*, 108*b* are then urged outward again by the springs 128 so as to be centered on the hollow core of the paper roll 106. The springs 128 bias the pivot members 108*a*, 108*b* into the hollow core of the paper roll 106 such that the paper roll 106 is supported by the pivot members 108*a*, 108*b*. Then, the paper roll 106 is free to turn along its axis and paper can be dispensed.

To remove a paper roll 106 from the paper roll dispenser 100, the user grabs the paper roll 106 and moves it upwards normal to the top face 118 of the pivot members 108*a*, 108*b*. As the paper roll 106 moves, the bottom of the paper roll 106 contacts the front face 120 of the pivot members 108*a*, 108*b*, and the pivot members 108*a*, 108*b* pivot into the side arms 102*a*, 102*b* in the manner described above. Then, when the paper roll 106 clears the pivot members 108*a*, 108*b*, the pivot members 108*a*, 108*b* are urged out toward the center of the paper roll dispenser 100 by the springs 128 until the cavity shields 110 make contact with the sides of the aperture 127 in the side arms 102*a*, 102*b*. Advantageously, both the insertion and removal of the paper roll 106 can be achieved using only one hand. Hence, people can insert and remove paper rolls 106 easily and quickly, even if they are physically challenged.

Figure 5:
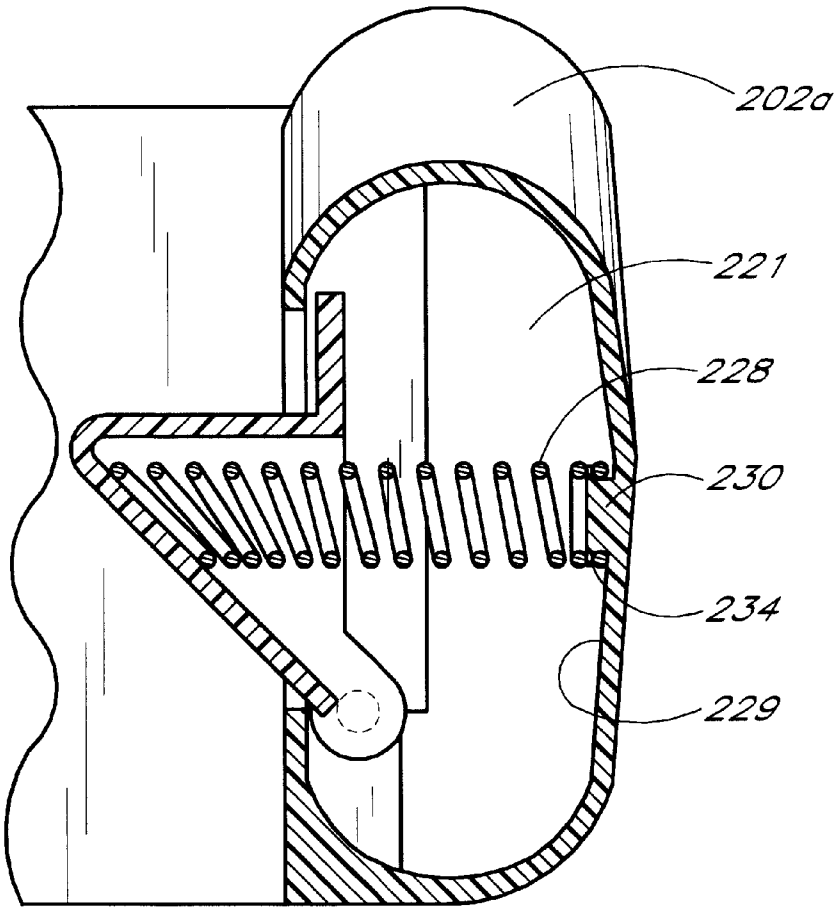
FIG. 5 is another cross-sectional view illustrating another embodiment of the paper roll dispenser of FIGS. 1A and 1B.

FIG. 5 illustrates another embodiment of the paper roll dispenser 100. As shown, a spring mount 230 with a collar 234 resides on an inner side wall 229 of the side arm 202*a* at a height above the bottom surface 241 of the cavity 243 that is approximately equal to the height of the pivot arm 108. In this way, the spring 228 extends laterally across the cavity 243 such that the force of the spring in compression and extension is directly exerted against the pivoting member 108. The use of the retaining spring mount 230 retains the spring in this orientation during operation of the apparatus. The spring 228 connects to the spring mount 230 in the same manner as described above in relation to spring mount 130. Also shown is a pivot member 208*a* that is essentially the same as the pivot member 108*a* described above. As shown, an opposite end 235 of the spring 228 rests inside a cavity 221 of the pivot member 208*a*. It should be noted that all features shown in FIG. 5 are the same structurally and perform the same function as the features described above. The only difference between the configuration shown in FIG. 5 and the configuration shown in FIGS. 3A and 3B is the location of the spring mount 230 and the absence of a spring mount inside the cavity 221 of the pivot member 208*a*.

This configuration of the paper roll dispenser 100 is advantageous for several reasons. First, the location of the spring mount 230 allows the axis of the spring 228 to remain essentially straight, even when the pivot member 208*a* is biased into the side arm 202*a*. Because the spring 228 remains straight, the forces in the spring 228 are primarily axial forces, and the amount of lateral forces on the spring 228 are minimal. This reduces the chances of the spring 228 dislodging from either the cavity 221 of the pivot member 208*a* or the spring mount 230. Thus, this would be a more robust configuration.

It should be noted that the spring mount 230 or collar 234 may not be needed inside the cavity 221 for retaining the end 235 of the spring 228 in all implementations. Extra retention force may not be needed at the end 235 of the spring 228 because the spring 228 remains essentially straight and has little chance to dislodge from the cavity 221 of the pivoting member 208*a*. Since no feature, like the spring mount 230 or collar 234, is needed, the paper roll dispenser 100 is easy to assemble because the spring 228 can be inserted into the cavity 221 without having to retain it further. In this implementation, assembly is simplified through the lack of a retainer. Also, this configuration may allow a less stiff spring to be used; other designs, like the routing of the spring 128 described above, require an overly-stiff spring to prevent the spring from dislodging due to its offset. A less stiff spring means that the user will need less force to insert and remove a paper roll 206. Another advantage is that a shorter spring 228 may be used because the spring mount 230 is closer to the hollow 221 as compared to the spring routing described above. A shorter spring 228 would be a less costly for the manufacturer.

The embodiment shown in FIG. 5 would be easier to assemble as well. This is because placing the spring mounts 230 in the position shown in FIG. 5 provides a more accessible location for mounting the spring as compared to the spring mount position described above. Assembly time is further reduced if the lower half shell 145 is shaped such that the entire periphery of the aperture 127 is encompassed by the lower half shell 145. In this instance, assembly would involve the installation of the pivoting members 208*a*, 208*b* and their corresponding springs 228 into the lower half shell 145. The springs 228 would be rigidly attached at this point, and the pivoting members 208*a*, 208*b* would remain in their first position, with the cavity shields making contact with the inside of the lower half shell 145. Then, the upper half shell 141 would be attached to the lower half shell 145. Thus, assembly time is reduced because the person assembling the dispenser would have an not have to hold the pivoting members 208*a*, 208*b* in a biased position while the upper half shell 141 is attached to the lower half shell 145.

The use of the retainers in both implementations makes the apparatus significantly more robust as the springs are less likely to be dislodged from their desired orientations. Assembly is also simplified as the springs can be positioned on one of the retainers and retained in their desired orientation when the other components of the apparatus, such as the pivot arms, are assembled. The springs can then be positioned on the other retainer by simply forcing the spring end over the collar. The use of the retainers also allows for a less strong spring to be used as less biasing is required to prevent the spring from being inadvertently dislodged. The reduced spring bias allows for easier installation and removal of paper rolls particularly by physically challenged persons.

Although the illustrated embodiments of the present invention have shown, described, and pointed out the fundamental novel features of the invention, as applied to these embodiments, it will be understood that various omissions, substitutions and changes in the form of the detail of the device illustrated may be made by those skilled in the art without departing from the present invention. Consequently, the scope of the invention should not be limited to the foregoing description, but should be defined by the appended claims.

What is claimed is:

1. An apparatus for holding a roll of paper, the apparatus comprising:

a base member adapted to mount the apparatus onto a wall;

a first and a second arm having an inner and an outer surface wherein the first and second arms extend outward from the mounting plate so as to be spaced a first distance apart wherein the first distance is selected to be larger than the width of the roll of paper and wherein the first and second arms have apertures formed on the inner surfaces;

a first and a second pivoting member each having an outer perimeter and an apex wherein the first and second pivoting members are respectively mounted in the apertures in the first and second arms wherein the first and second pivoting members are biased inward into the space between the first and second arms in a first orientation such that apex of the first and second pivoting members are positioned a second distance apart that is less than the length of the roll of paper such that the roll of paper can be retained on the first and second pivoting members wherein the first and second pivoting member can be moved into a second orientation such that the apex of the first and second pivoting members are spaced a third distance apart that is greater than the length of the roll to permit removal of the roll; and a first and second cavity shield respectively mounted about the outer perimeter of the first and second pivoting member so as to extend outward therefrom a distance that is selected such that the first and second cavity shield contact the inner surface when the first and second pivoting member are in the first orientation such that the first and second cavity shields respectively substantially seal the first and second apertures.

2. The apparatus of claim 1, wherein the first and second pivoting members define a flat upper surface upon which the paper roll is positioned with the first and second pivoting members in the first orientation.

3. The apparatus of claim 2, wherein the first and second pivoting members define an angled surface that is positioned beneath the first surface and contacts the first surface adjacent the apex of the first and second pivoting members.

4. The apparatus of claim 3 wherein the first and second pivoting members are biased and the second surface is angled such that positioning the roll adjacent the second surface urging the roll towards the first surface results in the first and second pivoting members pivoting into the second orientation.

5. The apparatus of claim 4, wherein the first and second pivoting members are recessed into the aperture in the second orientation.

6. The apparatus of claim 2, wherein the cavity shields extend upward from the first surface of the first and second pivoting members and are positioned so as to be mounted within the first and second arms respectively such that when the first and second pivoting members are in the first orientation, the cavity shields are positioned adjacent the inner wall of the first and second arms.

7. The apparatus of claim 6, wherein the first and second pivoting members have side walls that interconnect the first surface and the second surface and wherein the cavity shields further extend outward from the sidewalls so as to inhibit entry of particulates through the gap between the aperture walls and the first and second pivoting members.

8. The apparatus of claim 1, wherein the interior of the first and second arms are hollow and define a bottom interior surface, an inner side interior surface and an outer side interior surface and wherein the first and second apertures are formed in the inner side interior surfaces of the first and second arms respectively.

9. The apparatus of claim 8, further comprising a first and second spring assembly that each include a retainer respectively formed on one of the interior surfaces of the first and second arms and a spring that is mounted to the retainer so as to be retained thereby and a spring that respectively engages with the first and second pivoting members so as to bias the first and second pivoting members into the first orientation.

10. The apparatus of claim 9, wherein the retainers are mounted on the bottom interior surfaces of the first and second arms.

11. The apparatus of claim 10, wherein the retainers are mounted on the outer side interior surfaces of the first and second arms at a height above the bottom interior surface that is substantially equal to the height of the aperture such that the spring extends laterally across the first and second arms.

12. The apparatus of claim 9, wherein the first and second spring assemblies further comprise a second retainer that retains a second end of the spring, wherein the second retainer is respectively mounted on the first and second pivoting members.

13. The apparatus of claim 12, wherein both the first and second retainers comprise a collar with a wider dimensioned upper surface that defines a recess that captures one of the loops of the spring to thereby retain the spring.

14. An apparatus for holding a roll of paper, the apparatus comprising:

a base member adapted to mount the apparatus onto a wall;

a first and a second arm having an inner and an outer surface and being hollow so as to define an interior surface wherein the first and second arms extend outward from the mounting plate so as to be spaced a first distance apart wherein the first distance is selected to be larger than the width of the roll of paper and wherein the first and second arms have apertures formed on the inner surfaces;

a first and a second pivoting member each having an outer perimeter and an apex wherein the first and second pivoting members are respectively mounted in the apertures in the first and second arms wherein the first and second pivoting members are biased inward into the space between the first and second arms in a first orientation such that apex of the first and second pivoting members are positioned a second distance apart that is less than the length of the roll of paper such that the roll of paper can be retained on the first and second pivoting members wherein the first and second pivoting member can be moved into a second orientation such that the apex of the first and second pivoting members are spaced a third distance apart that is greater than the length of the roll to permit removal of the roll; and a first and second spring assembly each including a spring that respectively engages with the first and second pivoting members so as to bias the first and second pivoting members into the first orientation and a retainer with a collar having wider dimensioned upper surface that defines a recess that captures one of the loops of the spring to thereby retain the spring respectively wherein the retainer is mounted to the interior surface of the first and second arms.

15. The apparatus of claim 14, wherein the first and second pivoting members define a flat upper surface upon which the paper roll is positioned with the first and second pivoting members in the first orientation.

16. The apparatus of claim 15, wherein the first and second pivoting members define an angled surface that is positioned beneath the first surface and contacts the first surface adjacent the apex of the first and second pivoting members.

17. The apparatus of claim 16 wherein the first and second pivoting members are biased and the second surface is angled such that positioning the roll adjacent the second surface urging the roll towards the first surface results in the first and second pivoting members pivoting into the second orientation.

18. The apparatus of claim 17, wherein the first and second pivoting members are recessed into the aperture in the second orientation.

19. The apparatus of claim 14, wherein the first and second pivoting members include a first and second cavity shield respectively mounted about the outer perimeter of the first and second pivoting member so as to extend outward therefrom a distance that is selected such that the first and second cavity shield contact the inner surface when the first and second pivoting member are in the first orientation such that the first and second cavity shields respectively substantially seal the first and second apertures.

20. The apparatus of claim 19, wherein the cavity shields extend upward from the first surface of the first and second pivoting members and are positioned so as to be mounted within the first and second arms respectively such that when the first and second pivoting members are in the first orientation, the cavity shields are positioned adjacent the inner wall of the first and second arms.

21. The apparatus of claim 20, wherein the first and second pivoting members have side walls that interconnect the first surface and the second surface and wherein the cavity shields further extend outward from the sidewalls so as to inhibit entry of particulates through the gap between the aperture walls and the first and second pivoting members.

22. The apparatus of claim 14, wherein the interior surface of the first and second arms define a bottom interior surface, an inner side interior surface and an outer side interior surface and wherein the first and second apertures are formed in the inner side interior surfaces of the first and second arms respectively.

23. The apparatus of claim 22, wherein the retainers are mounted on the bottom interior surfaces of the first and second arms.

24. The apparatus of claim 22, wherein the retainers are mounted on the outer side interior surfaces of the first and second arms at a height above the bottom interior surface that is substantially equal to the height of the aperture such that the spring extends laterally across the first and second arms.

25. The apparatus of claim 22, wherein the first and second spring assemblies further comprise a second retainer that retains a second end of the spring, wherein the second retainer is respectively mounted on the first and second pivoting members.

* * * * *